US008544693B2

(12) United States Patent
Padain et al.

(10) Patent No.: US 8,544,693 B2
(45) Date of Patent: Oct. 1, 2013

(54) BOTTLE WITH A TAMPER-PROOF CAP

(75) Inventors: Christopher Leonard Padain, Montvale, NJ (US); Jacobus Simon Petrus Van Diepen, Heidelberg (DE)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 225 days.

(21) Appl. No.: 13/129,166

(22) PCT Filed: Nov. 16, 2009

(86) PCT No.: PCT/GB2009/002678

§ 371 (c)(1),
(2), (4) Date: Oct. 31, 2011

(87) PCT Pub. No.: WO2010/055313

PCT Pub. Date: May 20, 2010

(65) Prior Publication Data

US 2012/0125877 A1 May 24, 2012
US 2012/0261376 A2 Oct. 18, 2012

(30) Foreign Application Priority Data

Nov. 17, 2008 (GB) ..... 0820984.3

(51) Int. Cl.
*B65D 88/54* (2006.01)

(52) U.S. Cl.
USPC ..... 222/153.06; 222/185.1; 222/325; 222/541.6

(58) Field of Classification Search
USPC ..... 222/153.06, 185.1, 325, 541.6, 182, 222/183, 153.05, 541.1; 215/254, 253, 250; 220/266, 265, 260
See application file for complete search history.

(56) References Cited

U.S. PATENT DOCUMENTS

| | | | | |
|---|---|---|---|---|
| 4,018,363 | A * | 4/1977 | Cassia | 222/80 |
| 4,930,668 | A * | 6/1990 | Krall | 222/212 |
| 5,060,830 | A * | 10/1991 | Krall | 222/212 |
| 6,609,637 | B1 * | 8/2003 | Suffa | 222/545 |
| 2002/0096540 | A1 * | 7/2002 | Gross et al. | 222/185.1 |
| 2007/0278174 | A1 * | 12/2007 | Kunz et al. | 215/224 |
| 2010/0327009 | A1 * | 12/2010 | Hofte | 222/1 |
| 2011/0024466 | A1 * | 2/2011 | Mazooji et al. | 222/325 |
| 2012/0097711 | A1 * | 4/2012 | Xianzhi et al. | 222/325 |

FOREIGN PATENT DOCUMENTS

EP 1304296 A * 4/2003

* cited by examiner

*Primary Examiner* — Stephen Castellano
(74) *Attorney, Agent, or Firm* — Ryan A. Schneider; Troutman Sanders LLP

(57) ABSTRACT

The present invention is directed to a bottle (20) with a tamper-proof cap (21) with an outlet in the cap for dispensing the liquid from the bottle. The bottle is designed, in particular, for use in an inverted configuration, namely with the outlet lowermost in normal use, in a device for dispensing liquid soap or the like.

5 Claims, 10 Drawing Sheets

BOTTLE WITH A TAMPER-PROOF CAP

CROSS-REFERENCE TO RELATED APPLICATIONS

This application is a US National Stage of International Application No. PCT/GB2009/002678, filed 16 Nov. 2009, which claims the benefit of GB 0820984.3, filed 17 Nov. 2008, both herein fully incorporated by reference.

FIELD OF THE INVENTION

The present invention relates to a bottle with a tamper-proof cap.

BACKGROUND OF THE INVENTION

Many tamper-proof caps are known in the art which are designed to demonstrate to a user whether or not a cap has previously been removed. The most common tamper-proof cap is a screw-on lid, the lower lip of which is attached to a collar via a frangible element. The collar is prevented from rotating with the cap so that, when the cap is rotated, the frangible elements break to separate the collar from the lid thereby providing a visual indication that the cap has previously been opened.

BRIEF SUMMARY OF THE INVENTION

The present invention is directed to a bottle with a tamper-proof cap with an outlet in the cap for dispensing the liquid from the bottle. The bottle is designed, in particular, for use in an inverted configuration, namely with the outlet lowermost in normal use, in a device for dispensing liquid soap or the like. The bottle is designed to be a refill which sits above a base which houses a mechanism for selectively dispensing a liquid such as soap from the dispenser, either by a hand operated pump, or by an automated system which detects the proximity of a user's hands and activates a pump to automatically dispense the liquid. Once the refill is empty, if the user could remove the cap and refill the bottle, there is a danger that they would fill the bottle with a product which was incompatible with the dispensing device, or would fail to replace the cap properly resulting in leakage into the base which would at best be messy and at worst would damage the device.

According to the present invention, there is provided a bottle with a tamper-proof cap with an outlet therethrough, the bottle having a neck that is attached to the cap, a retaining shoulder adjacent to the end of the neck and facing away from the open end of the neck, the cap comprising at least one retaining member having a retaining shoulder complementary to the shoulder on the bottle, the retaining member being attached to the cap by a frangible member, whereby insertion of the bottle into the cap causes the retaining member to deflect so that the shoulder on the bottle passes the retaining member, whereupon the retaining member is resiliently biased back to its normal position so that its retaining shoulder co-operates with the retaining shoulder on the bottle to hold the bottle and cap together, and whereby pulling the cap from the bottle causes the shoulder on the bottle to bear against the shoulder on the retaining member and distort or break the frangible member thereby moving the retaining member to a position which prevents the cap from being subsequently retained on the bottle.

Thus, the user is able to use the bottle as normal to dispense liquid from the outlet. Once the bottle is empty, if the user removes the cap, they will distort or break the frangible member so that the retaining member will no longer be effective. This will prevent them from re-securing the lid to the bottle.

There may be a single arcuate retaining member which may either fully encircle the neck of the bottle, or may extend around a substantial proportion of the neck. However, preferably, there are a plurality of arcuate retaining members spaced around the circumference of the neck. Having a plurality of such members makes it easier for them to deflect as the bottle is inserted into the cap.

The plurality of retaining members may extend all the way around the cap. However, preferably, the retaining members are spaced intermittently around the cap. If this is the case, a frangible member is preferably attached at each end of the retaining member. Alternatively, there may be a plurality of frangible members connected between the cap and the surface of the retaining member which faces the cap. Between the intermittent retaining members, there may be a plurality of support members to complete the circle.

Preferably, a tapered surface is provided on at least one of the end of the neck and the retaining member to assist in deflecting the retaining member when the bottle is inserted into the cap.

BRIEF DESCRIPTION OF THE DRAWINGS

A bottle with a tamper-proof cap will now be described with reference to the accompany drawings, in which.

DETAILED DESCRIPTION OF PREFERRED EMBODIMENTS

Figure 1:
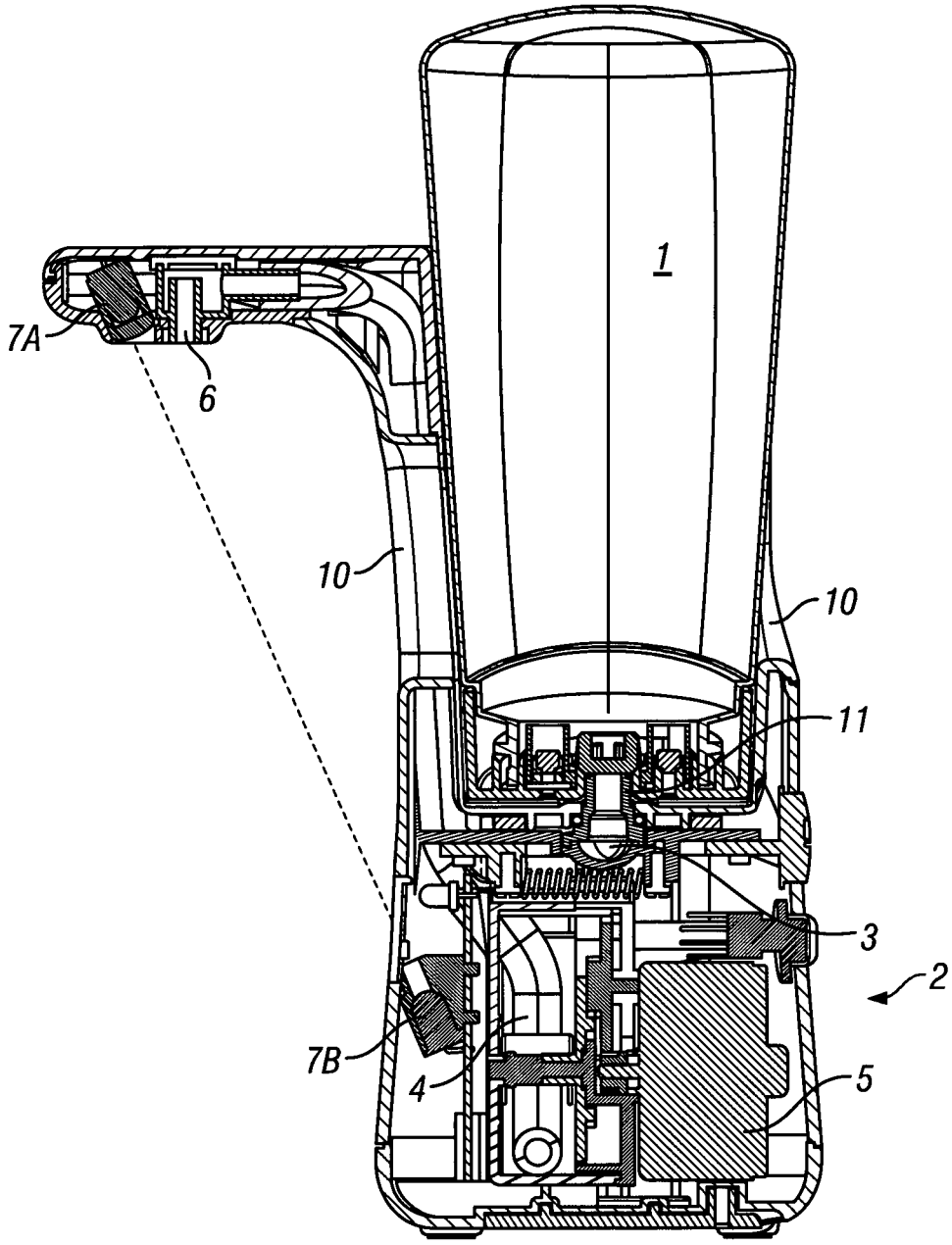
FIG. 1 is a cross-section through a dispenser.

The dispenser is a hands-free dispenser which is generally suitable for domestic use. The dispenser is primarily intended to dispense liquid soap, but may also be used to dispense other liquid or semi-liquid products (ideally with a viscosity greater than water), such as hand cream, body lotion, moisturiser, face cream, shampoo, shower gel, foaming hand wash, shaving cream, washing up liquid, toothpaste or a sanitising agent such as alcohol gel.

The dispenser comprises two main parts, namely a refill 1 and a base unit 2. The refill 1 provides a reservoir of liquid to be dispensed and is fitted to the base unit 2 as set out below.

The base has an interface 3 into which liquid is dispensed from the refill unit. The interface 3 is in fluid communication with a dispensing tube 4. A pump 5 is selectively operable to pump a metered dose of the liquid along dispensing tube 4 and out of dispensing head 6.

The base has an infrared transmitter 7A which transmits an infrared beam through a window 8 to a receiver 7B to sense the presence of a user's hands in the vicinity of the dispenser. Control circuitry reacts to a signal from the proximity sensor to activate the pump. The illustrated sensor is a break beam sensor, but may also be a reflective sensor. Although an infrared sensor is shown, any known proximity sensor such as a capacitive sensor may be used. The device may be mains powered or battery powered. Alternatively, it may be a manually operated pump device in which a user pushes a lever to displace the product.

The interface between the refill 1 and base unit 2 will now be described in greater detail with reference to FIGS. 2 to 10.

The base unit 2 comprises a cowling 10 which forms a cup-shaped housing surrounding a significant portion of the refill to protect and support it. A spigot 11 projects through the base of the cowling 10 and is sealed to the cowling 10 by an O-ring seal 12. The spigot has a plurality of castellations 13 in its top surface. A second O-ring seal 14 surrounds the spigot 11 beneath the castellations 13.

The refill 1 comprises a bottle 20 to which a cap 21 is fixed. The bottle 20 has a neck 22 which fits over and seals with an annular flange 23 within the cap 21. The cap 21 has an upwardly depending skirt 24 (when in the inverted orientation shown in the drawings) which forms the outer surface of the cap. Working inwardly from the skirt 24, the next feature of the cap is an outer annular wall 25 which is generally co-axial with the skirt 24.

This is shown in detail in FIGS. 5 to 10.

Figure 2:
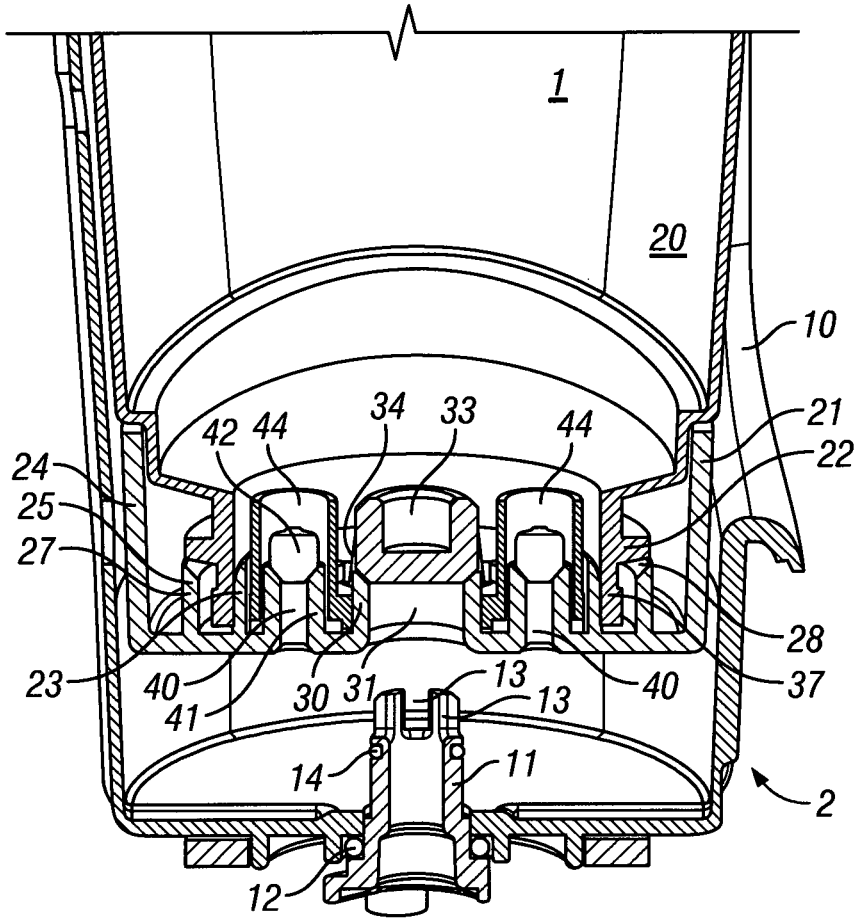
FIG. 2 is a cut-away perspective view of the refill being introduced into the dispenser but not yet being engaged.
Figure 5:
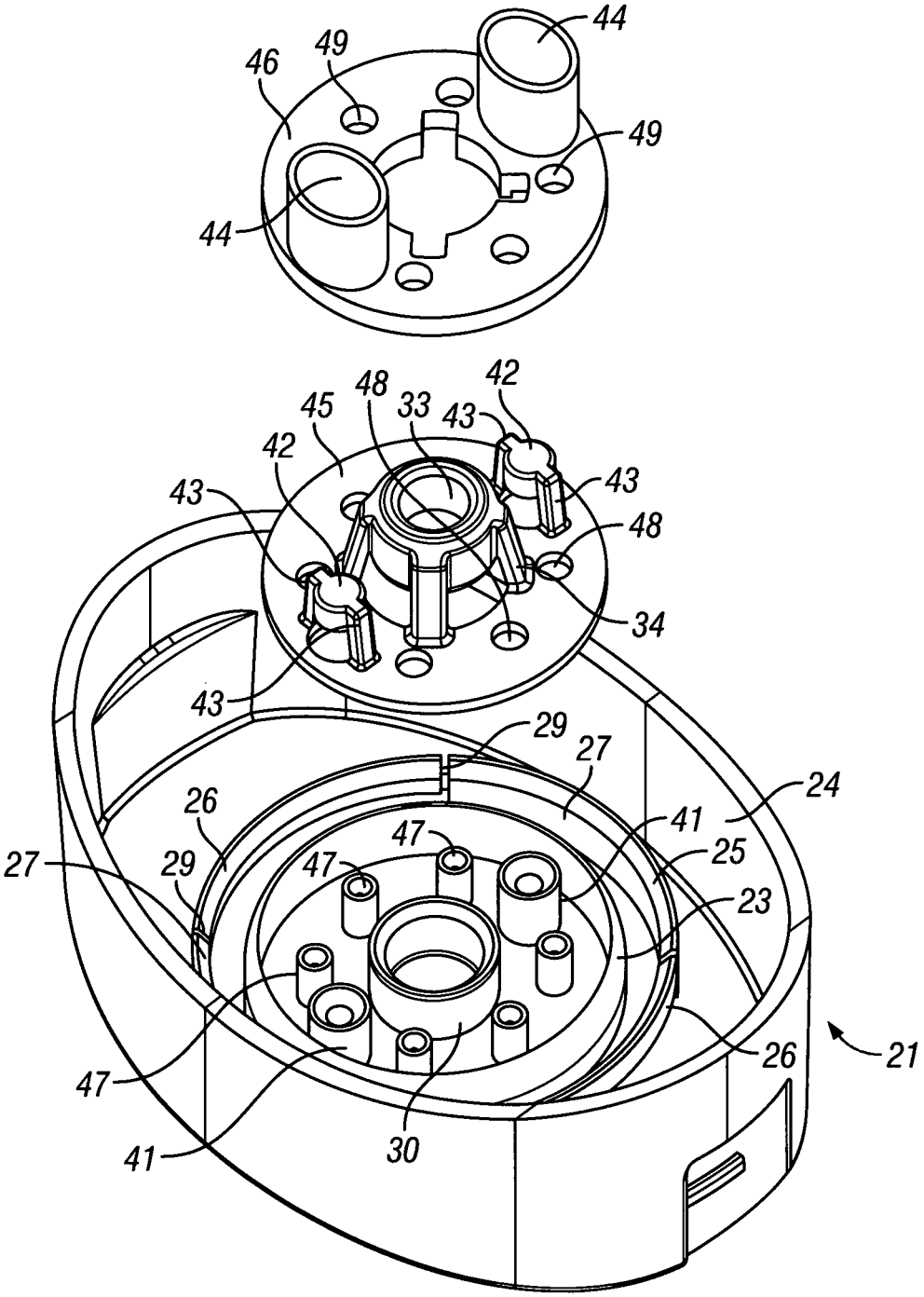
FIG. 5 is a perspective view of the cap assembly prior to assembly.
Figure 6:
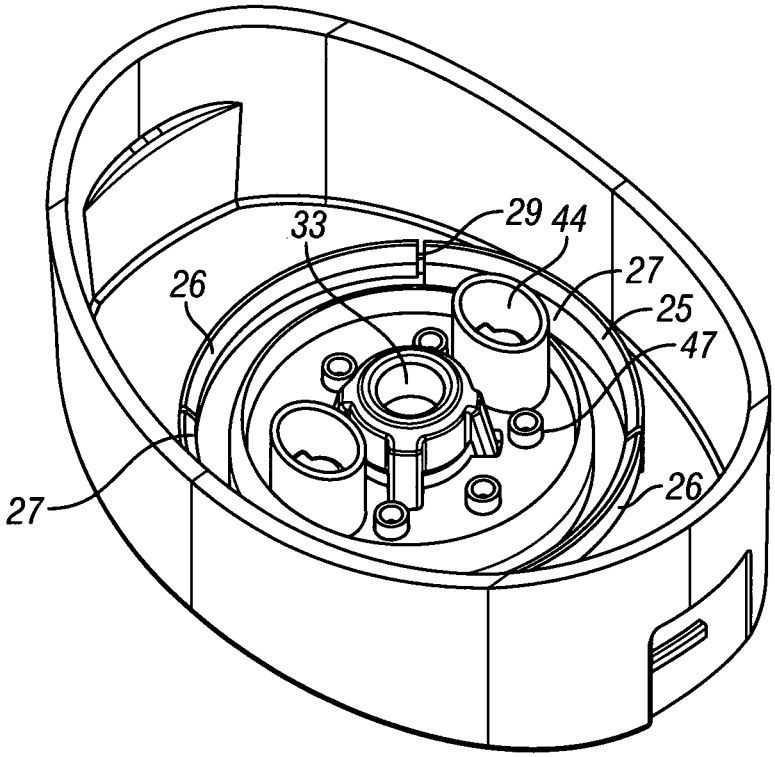
FIG. 6 is a perspective view of the cap assembly after assembly.
Figure 7:
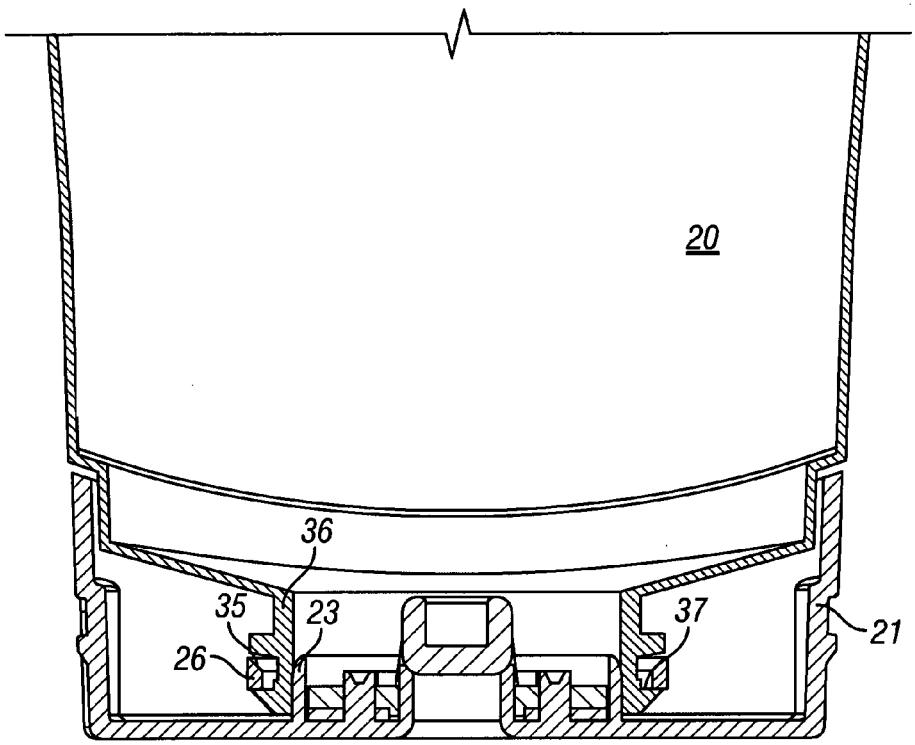
FIG. 7 is a cross-section showing the engagement between the bottle neck and cap assembly.
Figure 8:
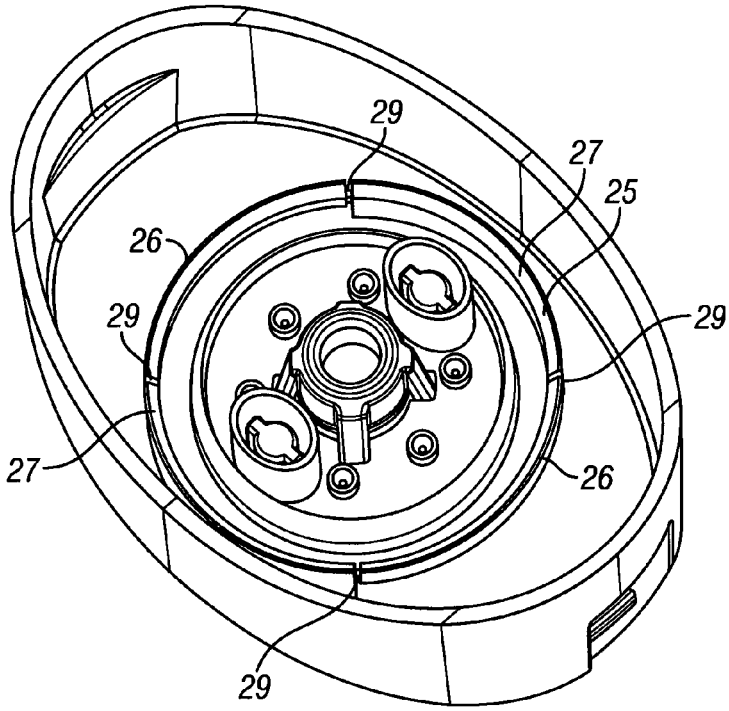
FIG. 8 is a perspective view of the cap with the frangible members intact.
Figure 9:
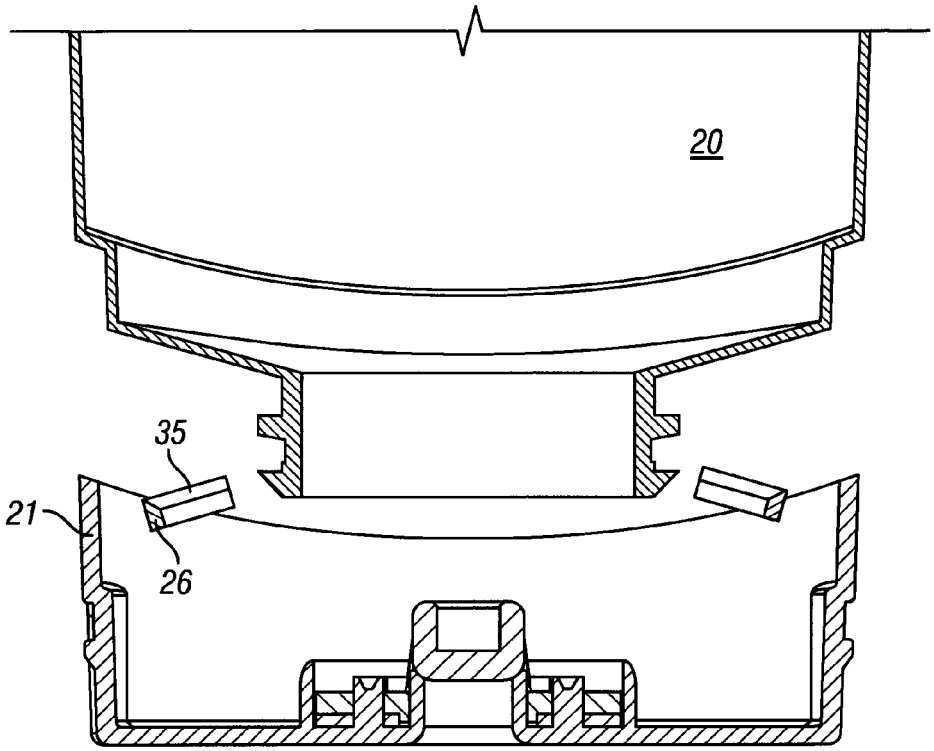
FIG. 9 is a view similar to FIG. 7 after the bottle has been removed from the cap.

The outer annular wall 25 consists of a pair of retaining members 26 and a pair of support members 27 which alternate with one another and each extend for approximately a quarter of the circle as shown in FIGS. 5, 6, 8 and 10. The profile of the support members 27 is as shown in FIG. 2. These members extend directly up from the lower wall of the cap, are parallel sided and have an inclined upper surface 28. The profile of the retaining members 26 is shown in FIGS. 7 and 9. Unlike the support members 27, these are not fixed to the wall of the cap. Instead, they are fixed at either end to the support members 27 by frangible members 29 as best shown in FIGS. 6 and 8. The retaining members 26 are parallel sided and have an inclined upper surface 35 as shown in FIGS. 7 and 9.

As shown in FIGS. 7 and 9, the neck 22 of the bottle has an inclined outer surface 36 which is complimentary to the inclined surfaces 28 and 35 of the annular wall 25. Behind the inclined outer surface 36 is a shoulder 37 which faces the main body of the bottle 20. This inclined outer surface 36 and shoulder 37 is only present in the vicinity of the retaining members 26 and not in the vicinity of the support members 27. Adjacent to the support members 27, the neck 22 has a parallel sided configuration as shown in FIG. 2.

Figure 10:
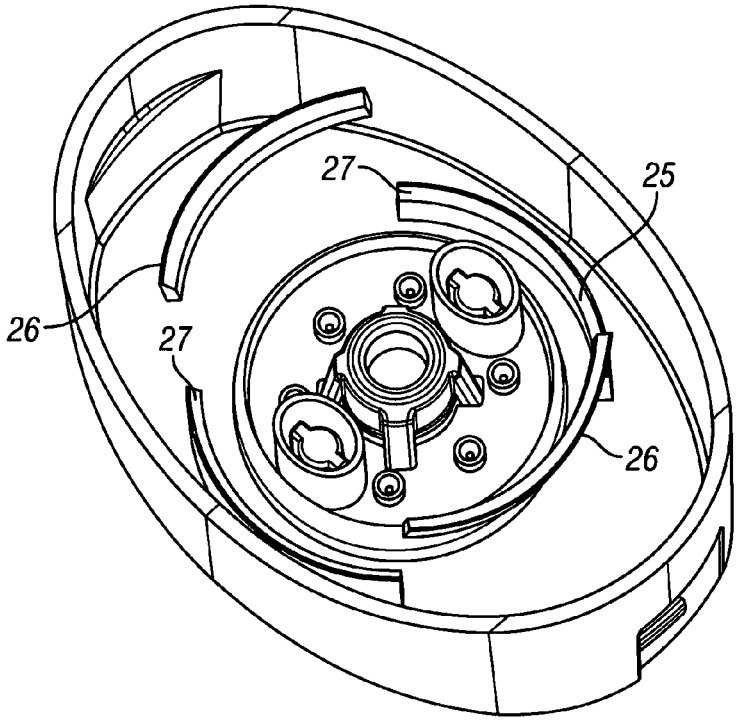
FIG. 10 is a view similar to FIG. 8 after the frangible members have broken off.

In order to insert the bottle 20 into the cap 21, the bottle 20 is pushed down with its neck fitting over the annular flange 23. The inclined outer surface 36 of the bottle co-operates with the inclined surfaces 28, 35 to displace the retaining members 26 radially outwardly until the shoulder 37 snaps into place behind the retaining members 26 as shown in FIG. 7. When the bottle 20 is pulled off of the cap 21, the shoulders 37 bear against the retaining members 26, thereby breaking frangible members 29 so that the retaining members 26 become detached from the cap 21 as shown in FIGS. 9 and 10. Once this has happened, it is no longer possible to retain the cap on a bottle, thereby preventing subsequent use of the refill 1.

It should be noted that it is not necessary for both of the retaining members 26 to become fully detached from the lid. It is possible that only one of these becomes detached, or that one or both are simply displaced to a location at which they can no longer engage with the neck of the bottle.

Returning now to FIGS. 2 to 4, the liquid outlet and associated valve will now be described.

The liquid outlet from the reservoir is provided by an annular wall 30 surrounding a central opening 31. At the top of the annular wall 30 is an inclined surface 32 (see FIG. 4) which provides a valve seat for outlet valve element 33. This is shown in the form of a U-shape cup-like member, but may equally be a solid member or a hollow ball-like member. The outlet valve element 33 is biased into its closed position by a plurality of biasing elements 34. These are attached at their upper end towards the top of the valve element 33 and are attached at their lower ends at a location radially outward of the annular wall 30 and below the top of the annular wall 30. They are preferably formed integrally with the valve element 33.

Figure 3:
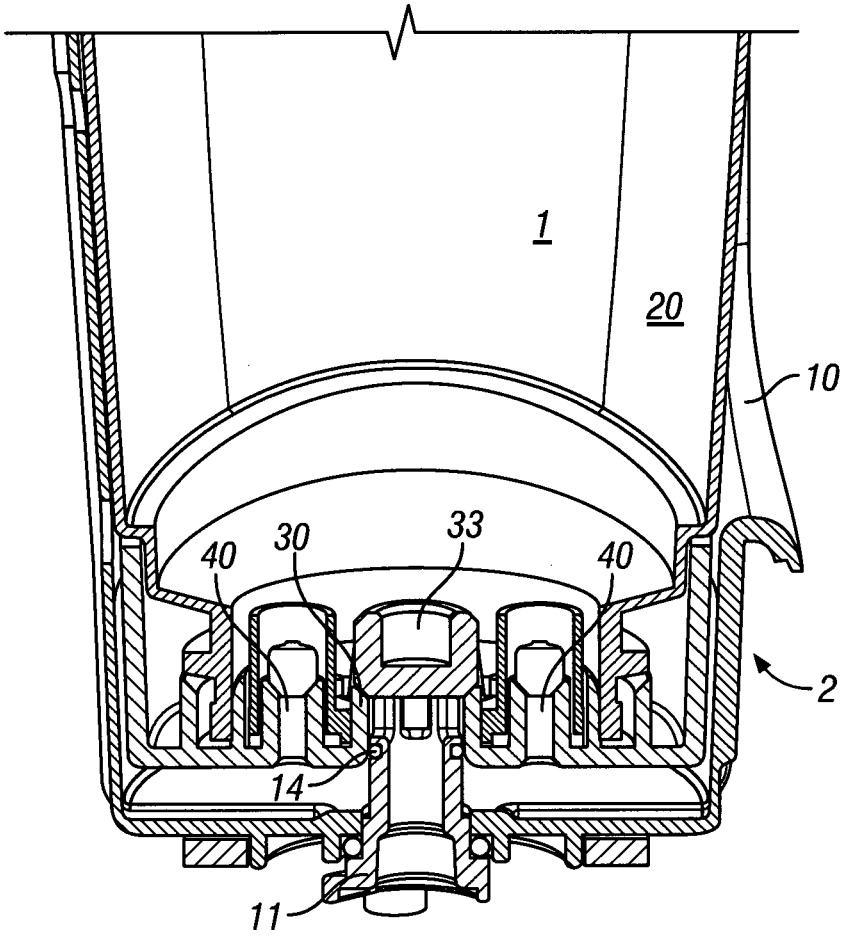
FIG. 3 is a view similar to FIG. 2 showing the refill in an intermediate position.
Figure 4:
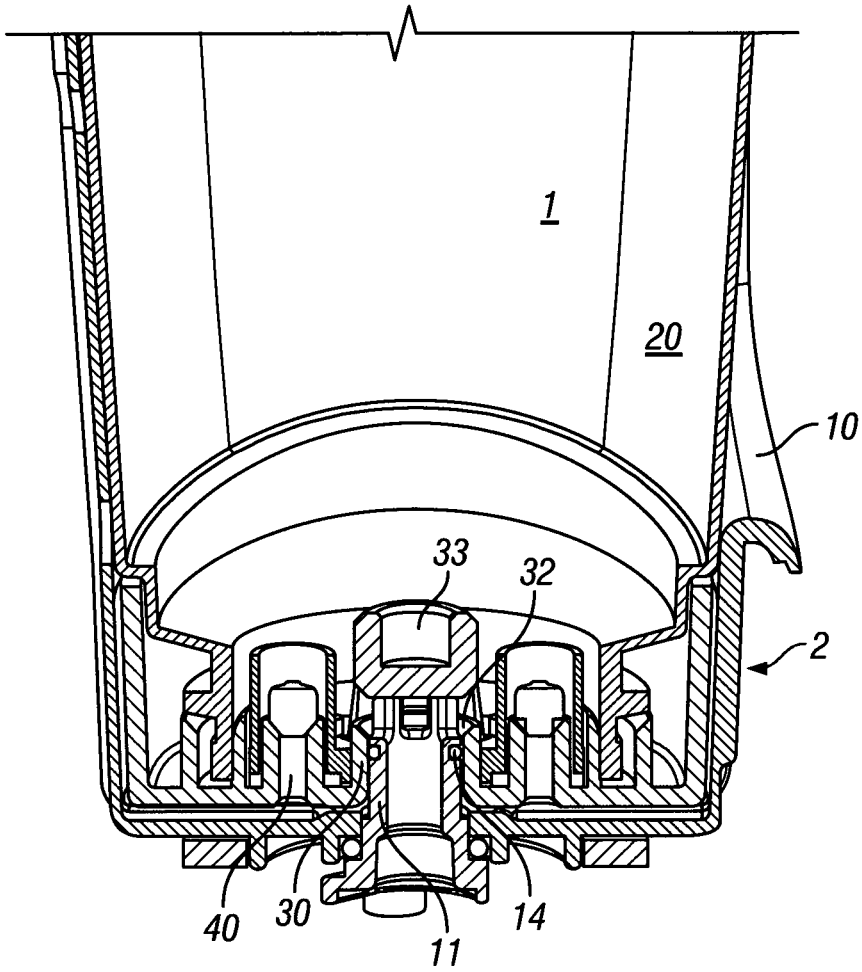
FIG. 4 is a view similar to FIGS. 3 and 4 showing the refill in its fully engaged position.

As shown in FIGS. 2 to 4, when the refill 1 is lowered into the base unit 2, the spigot 11 engages with the lower surface of the valve element 33 as shown in FIG. 3. Further downward movement of the refill causes the valve element 33 to be lifted from its seat, and also brings the O-ring 14 into sealing engagement with the annular wall 30. The valve element 33 is lifted to the position shown in FIG. 4. In this position, liquid in the bottle 20 can flow around the biasing elements 34, and enter the spigot via the castellations 13 and hence flow into the base unit 2. Liquid is prevented from escaping between the spigot 11 and annular wall 30 by the O-ring seal 14. This arrangement offers a simple and mess-free way for a consumer to insert a refill regardless of the fill level of the refill.

In order to remove a refill, the consumer lifts it out of the base whereupon the biasing elements 34 cause the valve element 33 to return to the seat 32. During this movement, the seal between the spigot 11 and annular wall 30 is maintained by the O-ring seal 14. A spent refill is then replaced by a new one following the above procedure.

The cap is provided with a pair of pressure relief valves 40. Each is formed by an annular boss 41 integral with the cap 21. A pressure relief valve element 42 is seated on the top of the annular boss 41 and is biased in place by a pair of biasing elements 43 (as shown, for example, in FIG. 5). The biasing force is such that, under normal conditions, the pressure relief valve element 42 forms an air tight seal on the boss 41. However, when the pressure within the bottle 20 drops below a certain level, the pressure differential across the relief valve element 42 is sufficient to overcome the force exerted by biasing elements 43 and to allow air into the bottle 20. This reduces the pressure differential thereby restoring the air tight seal without leakage of fluid.

Each pressure relief valve 40 is surrounded by an annular barrier 44 which extends axially to a level axially above the level of the top of the annular wall 30. Thus, when the valve element 33 is open, any air entering the relief valve 40 will not become entrained in the outgoing liquid stream. In practice, this means that the relief valve can be placed closer to the outlet, thereby resulting in a more compact cap. Although two relief valves are shown, a single valve, or more than two valves could be provided if necessary.

The manner in which the cap is assembled is illustrated in FIGS. 5 and 6.

The assembly is a three-part structure consisting of the cap 21, a valve plate 45 and a fixing plate 46. The cap has a number of moulded features including the annular flange 23, annular wall 25 and annular bosses 41. In addition, the cap 21 has a plurality of fixing posts 47.

The valve plate 45 is an elastomeric material and is integrally formed with the valve element 33, biasing elements 34, relief valve element 42 and biasing elements 43. The valve plate has a plurality of locating holes 48 which correspond to the fixing posts 47.

The fixing plate 46 is made of a rigid plastics material and is integrally formed with the annular barrier 44. As with the valve plate 45, the fixing plate 46 is also provided with a plurality of locating holes 49 which correspond to the fixing posts 47.

To assemble the cap, the three components are placed on top of one another as shown in FIG. 6 with the fixing posts entering the locating holes to ensure that the components are correctly aligned. Heat or adhesive is then applied to the top of the fixing posts 47 to secure the fixing posts to the fixing plate 46. The elastomeric valve plate 45 is thereby sandwiched between the cap 21 and fixing plate 46 which holds the valve elements 33 and 42 in position.

A second example of a cap for a refill unit will now be described with reference to FIGS. 11 to 14.

The structure of the outlet valve element 33 in the second example is essentially the same as the first example, and will not be described again in relation to the second example.

Figure 11:
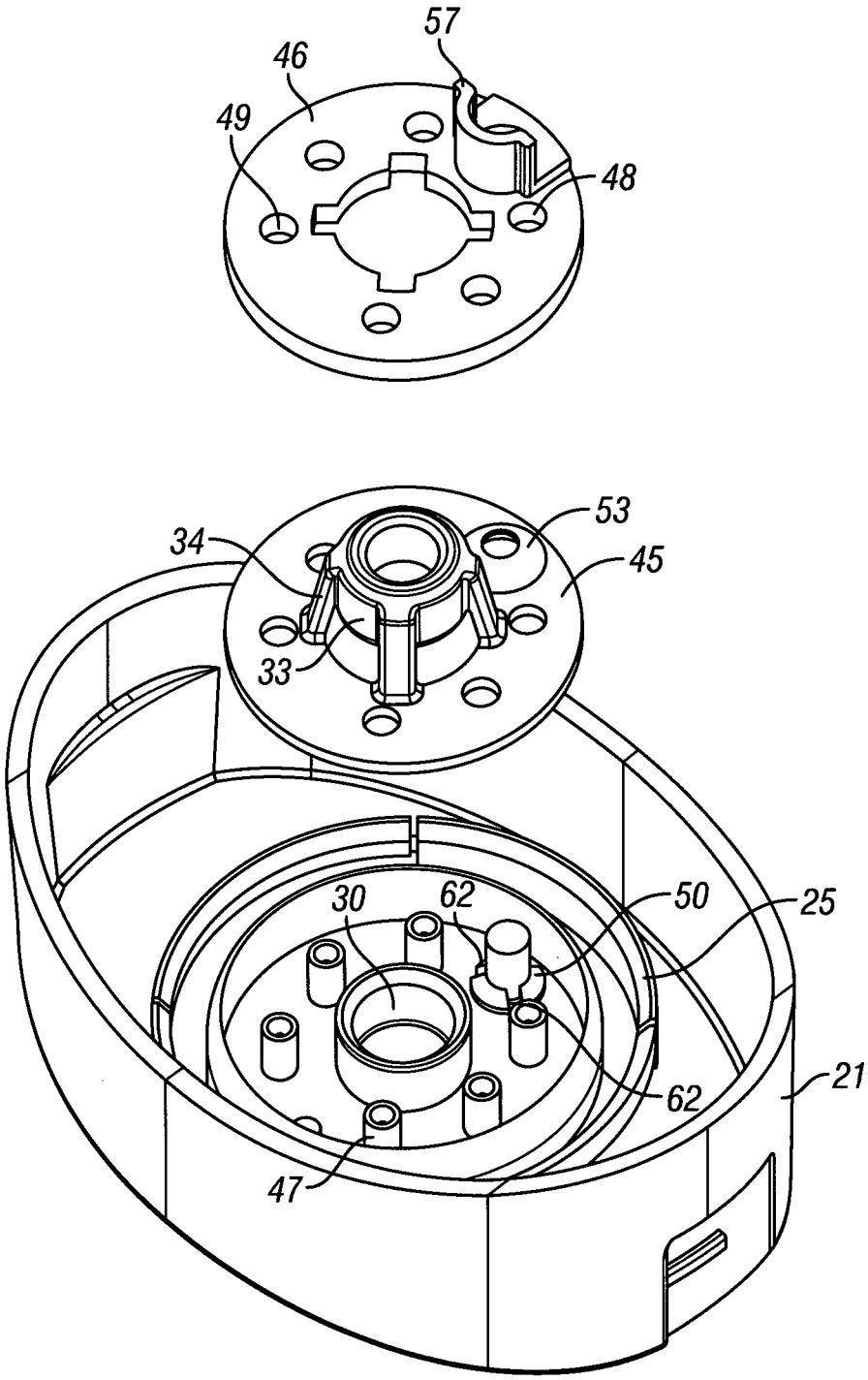
FIG. 11 is an exploded perspective view of a cap of a second refill unit.
Figure 12:
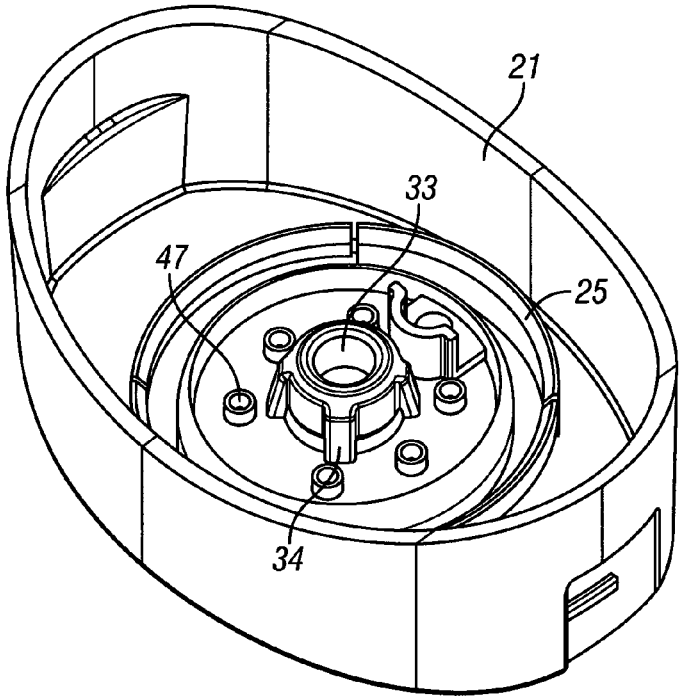
FIG. 12 is a view similar to FIG. 11 showing the assembled cap.

As can be seen from FIG. 11, the cap 21 is integrally molded with a number of features, such as the annular walls 25 and 30 and a conical part 50 of the pressure relief valve which will be described below. A resilient lip 53 (described in more detail below) for the pressure relief valve is provided integrally molded with the valve plate 45. The fixing plate 46 is also provided with a shield 57 for the relief valve. This is equivalent to the barrier 44 in FIG. 2, but only extends around the side of the relief valve facing the outlet valve element 33. The barrier 44 and shield 57 could be used interchangeably in the two examples.

The cap assembly is assembled in the same manner as in the first example.

Figure 13:
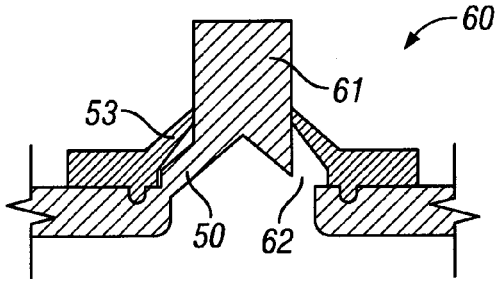
FIG. 13 is a cross-sectional view through the pressure relief valve of the second example.
Figure 14:
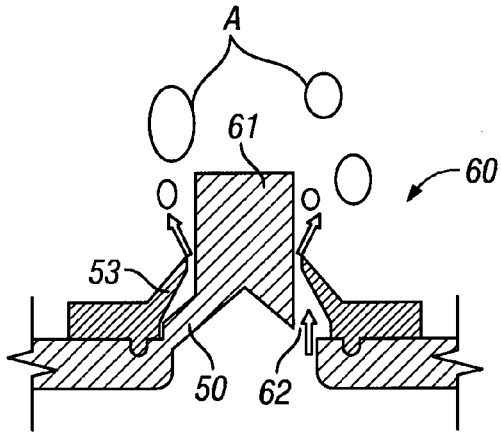
FIG. 14 is a view similar to FIG. 13 showing the pressure relief valve in an open configuration to allow the flow of air.

The pressure relief valve 60 is illustrated in FIGS. 13 and 14.

The valve has the conical part 50 which is an integral part of the cap 21 as mentioned above. At the top of the conical part 50 is a cylindrical post 61. The resilient lip 53 is effectively a hollow frustoconical extension of the valve plate 52 of resilient material which extends along the conical part 50 from which it diverges slightly and is a tight fit against the post 61. At least one air inlet 62 (also shown in FIG. 11) passes through the wall of the conical part 50 and is normally covered by the resilient lip 53 as shown in FIG. 11. When the pressure in the bottle 20 falls as liquid is emptied the pressure differential across the resilient lip 53 will eventually become sufficient to displace the lip 53 to a sufficient degree to allow air A into the bottle 20 as shown by the arrows in FIG. 8. It should be noted that the degree to which the resilient lip 53 lifts from the conical element 50 has been exaggerated in FIG. 8 and that, in practice, this will be almost imperceptible.

Instead of sealing against the post, the resilient lip 53 may seal against the conical part 50. In this case, the lip will not diverge from the conical part as shown. Instead, it would actually have an angle of incline less than the angle of the conical part 50 so as to be naturally biased onto the conical part.

The invention claimed is:

1. A bottle with a tamper-proof cap with an outlet therethrough, the bottle having a neck that is attached to the cap, a retaining shoulder adjacent to the end of the neck and facing away from the open end of the neck, the cap comprising at least one retaining member having a retaining shoulder complementary to the shoulder on the bottle, the retaining member being attached to the cap by a frangible member, whereby insertion of the bottle into the cap causes the retaining member to deflect so that the shoulder on the bottle passes the retaining member, whereupon the retaining member is resiliently biased back to its normal position so that its retaining shoulder co-operates with the retaining shoulder on the bottle to hold the bottle and cap together, and whereby pulling the cap from the bottle causes the shoulder on the bottle to bear against the shoulder on the retaining member and distort or break the frangible member thereby moving the retaining member to a position which prevents the cap from being subsequently retained on the bottle.

2. A bottle according to claim 1, having a plurality of arcuate retaining members spaced around the circumference of the neck.

3. A bottle according to claim 2, wherein the retaining members are spaced intermittently around the cap.

4. A bottle according to claim 3, wherein there is a frangible member at each end of each retaining member.

5. A bottle according to claim 1, wherein a tapered surface is provided on at least one of the end of the neck and the retaining member to assist in deflecting the retaining member when the bottle is inserted into the cap.

* * * * *